US007533731B2

(12) United States Patent
Corre et al.

(10) Patent No.: US 7,533,731 B2
(45) Date of Patent: May 19, 2009

(54) CASING APPARATUS AND METHOD FOR CASING OR REPAIRING A WELL, BOREHOLE, OR CONDUIT

(75) Inventors: Pierre-Yves Corre, Eu (FR); Philippe Hocquet, Vanves (FR)

(73) Assignee: Schlumberger Technology Corporation, Sugarland, TX (US)

( * ) Notice: Subject to any disclaimer, the term of this patent is extended or adjusted under 35 U.S.C. 154(b) by 245 days.

(21) Appl. No.: 11/419,937

(22) Filed: May 23, 2006

(65) Prior Publication Data

US 2007/0272418 A1 Nov. 29, 2007

(51) Int. Cl.
*E21B 29/08* (2006.01)

(52) U.S. Cl. ..... 166/384; 166/297; 166/55; 166/187; 166/207; 166/277

(58) Field of Classification Search ..... 166/55, 166/122, 187, 207, 277, 297, 380, 384
See application file for complete search history.

(56) References Cited

U.S. PATENT DOCUMENTS

| | | | | |
|---|---|---|---|---|
| 4,886,117 | A | 12/1989 | Patel | |
| 5,000,261 | A | 3/1991 | Fitzgibbon, Jr. | |
| 5,348,096 | A * | 9/1994 | Williams | 166/384 |
| 5,417,289 | A | 5/1995 | Carisella | |
| 5,469,919 | A | 11/1995 | Carisella | |
| 6,044,906 | A | 4/2000 | Saltel | |
| 6,263,966 | B1 | 7/2001 | Haut et al. | |
| 6,457,518 | B1 | 10/2002 | Castano-Mears et al. | |
| 6,470,966 | B2 | 10/2002 | Cook et al. | |
| 6,497,289 | B1 | 12/2002 | Cook et al. | |
| 6,561,227 | B2 | 5/2003 | Cook et al. | |
| 6,684,947 | B2 | 2/2004 | Cook et al. | |
| 7,044,218 | B2 | 5/2006 | Cook et al. | |
| 2002/0056553 | A1 * | 5/2002 | Duhon et al. | 166/302 |
| 2003/0221840 | A1 * | 12/2003 | Whitelaw et al. | 166/380 |
| 2005/0115719 | A1 * | 6/2005 | Abercrombie Simpson et al. | 166/383 |
| 2005/0217866 | A1 * | 10/2005 | Watson et al. | 166/207 |
| 2006/0162938 | A1 * | 7/2006 | Lohbeck et al. | 166/380 |

FOREIGN PATENT DOCUMENTS

| | | |
|---|---|---|
| EP | 1653043 | 5/2006 |
| WO | WO9118180 | 11/1991 |

* cited by examiner

*Primary Examiner*—Jennifer H Gay
*Assistant Examiner*—Robert E Fuller
(74) *Attorney, Agent, or Firm*—Rodney Warfford; David Cate; Jamie Castano

(57) ABSTRACT

A casing apparatus is provided to install a hard, pressure-resistant seal along a wall of a well in situ. The casing apparatus includes a moving device and a deformable tubular sleeve having a first end and a second end and. The moveable element is radially inflatable and movable inside the deformable tubular sleeve along a longitudinal axis of the deformable tubular sleeve. When the moving device is radially inflatable to an inflated condition and is moved from the first end to the second end, the moving device deforms the deformable tubular sleeve radially against the wall and progressively from the first end to the second end. A force of deforming the tubular sleeve applied by the inflated moving device is adjustable by changing the inflated condition of the moving device during the deformation process.

20 Claims, 4 Drawing Sheets

CASING APPARATUS AND METHOD FOR CASING OR REPAIRING A WELL, BOREHOLE, OR CONDUIT

FIELD

The present disclosure relates generally to casing apparatuses and methods for casing or repairing a well, borehole, or conduit, and more particularly to setting tools used therein.

BACKGROUND

The statements in this section merely provide background information related to the present disclosure and may not constitute prior art.

Conventional methods of casing or repairing wells, boreholes, conduits and the like include applying cementation, straddle packers, metallic patches, or through-tubing casing patch using in situ polymerization such as Patch Flex™ (a trademark of Schlumberger) on the wall of the wells, boreholes, or conduits. A Patch Flex system involves an in-situ polymerization technology to install a hard, pressure-resistant seal on the wall along its length. U.S. Pat. No. 6,044,906 ("the '906 patent") issued to Saltel discloses a conventional Patch Flex system, which comprises an inflatable setting element ("ISE", called "inflatable tubular sleeve" in the '906 patent) and a preform made of a thermosetting resin and disposed around the ISE. A nozzle which engages the ISE inflates the ISE, which in turn expands the thermosetting preform radially against the wall of the well. When the ISE is completely inflated, the entire thermosetting resin preform is inflated accordingly and is then heated to cause polymerization of the preform. The preform is thus secured to the wall of the well. The ISE is then deflated and removed, leaving in place a permanent hard preform against the wall of well.

The conventional Patch Flex system has a disadvantage in that the casing length or the repair zone of the well is restricted by the length of the ISE because the expansion of the preform depends on fully inflation of the ISE along the length of the ISE. Currently, the ISE can be made to have a length of no more than about 10 meters and thus can repair or case a zone of no more than 10 meters. Moreover, the thermosetting resin preform has a limited lifetime before polymerization and requires more time to heat and cure, thereby prolonging the casing or repair process.

SUMMARY

Embodiments of the present invention provide for a casing apparatus and method for casing or repairing a wall of a well wherein the casing length is not limited by a setting tool that is used to deform the resin preform. In one preferred form, the casing apparatus comprises a deformable tubular sleeve having a first end and a second end, and a moving device. The moving device is movable inside the deformable tubular sleeve along a longitudinal axis of the deformable tubular sleeve for deforming the tubular sleeve radially against the wall of the well.

In another preferred form, a setting tool for deforming a deformable tubular sleeve is provided. The setting tool comprises a radially inflatable moving device movable inside the deformable tubular sleeve along a longitudinal axis. When the moving device is inflated to an inflated condition and moved from a first end to a second end of the tubular sleeve, the moving device deforms the tubular sleeve radially and progressively from the first end to the second end.

In still another form, a method of casing a wall of a well is provided. The method comprises disposing a casing apparatus in the well, the casing apparatus comprising a deformable tubular sleeve and a moving device, the moving device being radially inflatable and being movable inside the tubular sleeve from a first end to a second end of the deformable tubular sleeve; inflating the moving device to an inflated condition; and causing the moving device to move in the inflated condition from the first end to the second end, a force being exerted on the tubular sleeve by the moving device in the inflated condition, when the moving device is moved from the first end to the second end, the tubular sleeve being deformed radially against the wall and progressively from the first end to the second end.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
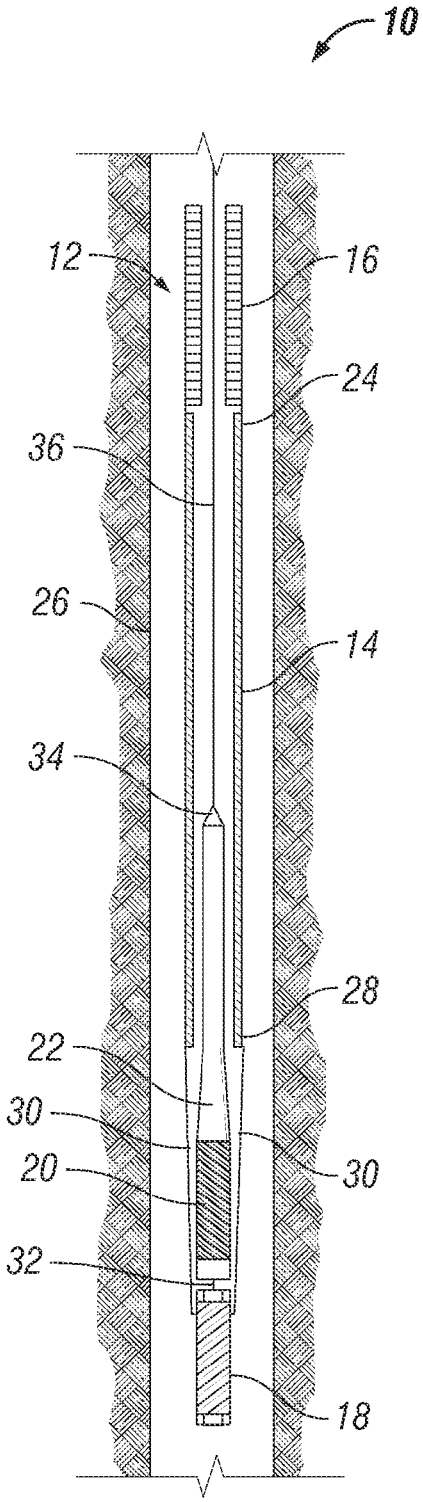
FIG. 1 is a cross-sectional view of a casing apparatus in accordance with the teachings of the present disclosure, wherein the casing apparatus is in its initial, deflated condition.

The description and drawings are presented solely for the purpose of illustrating the preferred embodiments of the invention and should not be construed as a limitation to the scope and applicability of the invention. While any compositions of the present invention are described herein as comprising certain materials, it should be understood that the composition could optionally comprise two or more chemically different materials. In addition, the composition can also comprise some components others than the ones already cited. It should be understood that throughout the drawings, corresponding reference numerals indicate like or corresponding parts and features.

At the outset, it should be noted that "deformable," "deform" or "deformation" used throughout the present disclosure, refers to an element that is (1) unfoldable or unfolded from a folded state to an unfolded state by simply unfolding without expanding, (2) expandable or expanded (without unfolding) by increasing the diameter of the element due to the effect of pressure applied to the inner surface of the element, or (3) successively unfolded from a folded state to an unfolded state and then expanded.

Figure 2:
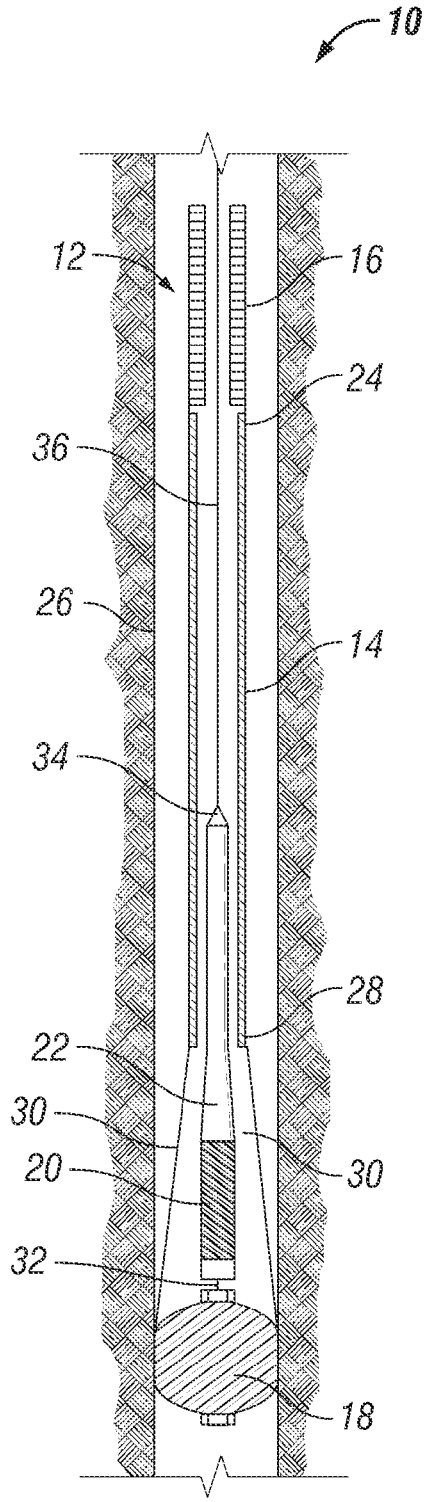
FIG. 2 is a cross-sectional view of the casing apparatus of FIG. 1, showing an anchoring device in its inflated condition.

Referring to FIGS. 1 and 2, a casing apparatus for casing a wall of a well constructed in accordance with the teachings of the present disclosure is illustrated and generally indicated by reference numeral 10. The casing apparatus 10 comprises a setting tool 12 and a tubular sleeve 14 disposed around the setting tool 12.

The setting tool 12 comprises a tensioning device 16, an anchoring device 18, an inflatable moving device 20, and a heating device 22. The tensioning device 16 engages an upper end 24 of the tubular sleeve 14 for suspending the tubular sleeve 14 within the wellbore 26 which penetrates a subterranean formation. The anchoring device 18 is attached to a lower end 28 of the sleeve 14 through linking cables 30. The linking cables 30 are made of chemically resistant and/or material resistant to mechanical forces, such as steel, polyaryletherether ketone polymer (PEEK), fibers, and the like. The linking cables 30 may be breakable by connection to a mechanical weak point, such as shear pin by nonlimiting example.

The anchoring device 18 engages a connecting member 32 passing through the moving device 20 and the heating device 22, and connecting to a pump (not shown) for inflating the anchoring device 18. The anchoring device 18 is made of an expandable material and can be inflated to an inflated condition to engage the well 26. When inflated, the anchoring device 18 holds the lower end 28 of the sleeve 14 in place. The tensioning device 16 and the anchoring device 18 cooperatively maintain a proper tension along a longitudinal direction of the sleeve 14.

Figure 3:
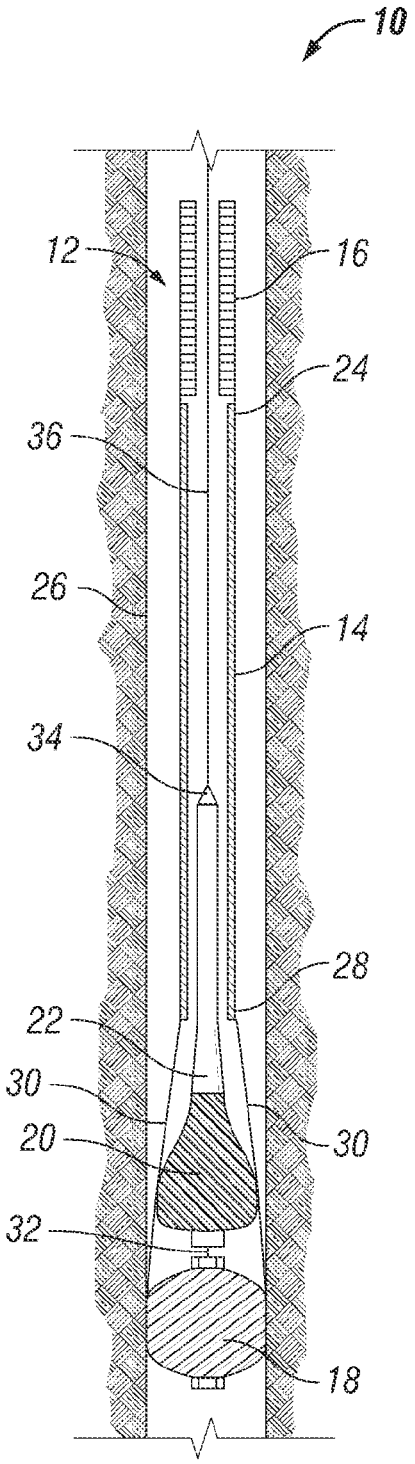
FIG. 3 is a cross-sectional view of the casing apparatus of FIG. 1, showing a moving device in its inflated condition.
Figure 4:
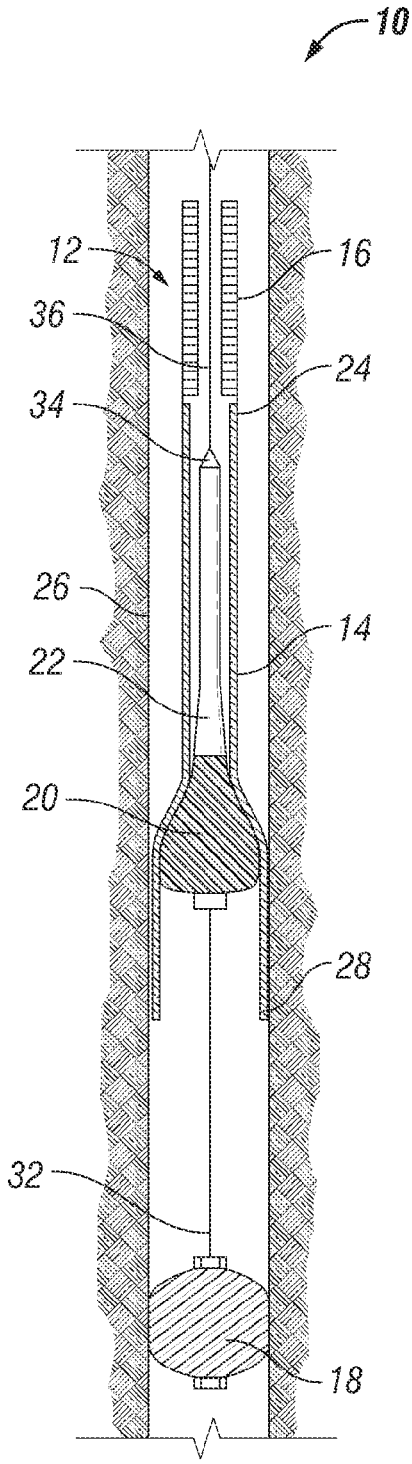
FIG. 4 is a cross-sectional view of the casing apparatus of FIG. 1, showing the start of a deformation process by the moving device.

Referring to FIGS. 3 and 4, the moving device 20 and the heating device 22 are suspended from a running tool 34 and movable inside the tubular sleeve 14. The running tool 34 can be an electronic device, a pump or a cable head, which guides the movement of the moving device 20 and the heating device 22 and provides fluids to inflate the anchoring device 18 and the moving device 20. The running tool 34 is connected to a cable or a coil tubing 36. When the cable or coiled tubing 36 is pulled up, the moving device 20, the heating device 22 and the running tool 34 are pulled up to move inside the tubular sleeve 14 along the longitudinal axis of the tubular sleeve 14.

When a cable is used to connect to the running tool 34, the cable 36 may be any suitable cable. Some non-limiting examples of cables are heptacable and quadcables. Preferably, the cable 36 is a heptacable, which refers to a cable consisting of seven conductors; a central conductor surrounded by six conductors and an outer steel armor. The heptacable provides for several different signal propagation modes, each of which transmits signals on a specific combination of the seven conductors and armor. By using the heptacable, control signals are transmitted through the cable 36 for controlling the switching on/off and temperature of the heating device 22, the inflating/deflating of the moving device 20 and the anchoring device 18.

The moving device 20 is made of an expandable material and can be radially inflatable and deflatable. The moving device 20 has a nut configuration with a central hole (not shown) to allow for passage of the connecting member 32 connected to the anchoring device 18. The moving device 20 engages an inflating member (not shown) passing though the heating device 22 for inflating the moving device 20. The connecting member 32 connected to the anchoring device 18 and the inflating member connected to the moving device 20 may be connected to the same pump or different pumps (not shown).

The heating device 22 has an elongated construction and is preferably a resistive heating element for heating the tubular sleeve 14. The temperature of the heating device 22 is properly controlled to a melting point of the tubular sleeve 14 during operation. The heating device 22 also has a central hole (not shown) for allowing passage of the connecting member 32 and the inflating member (not shown).

Figure 5:
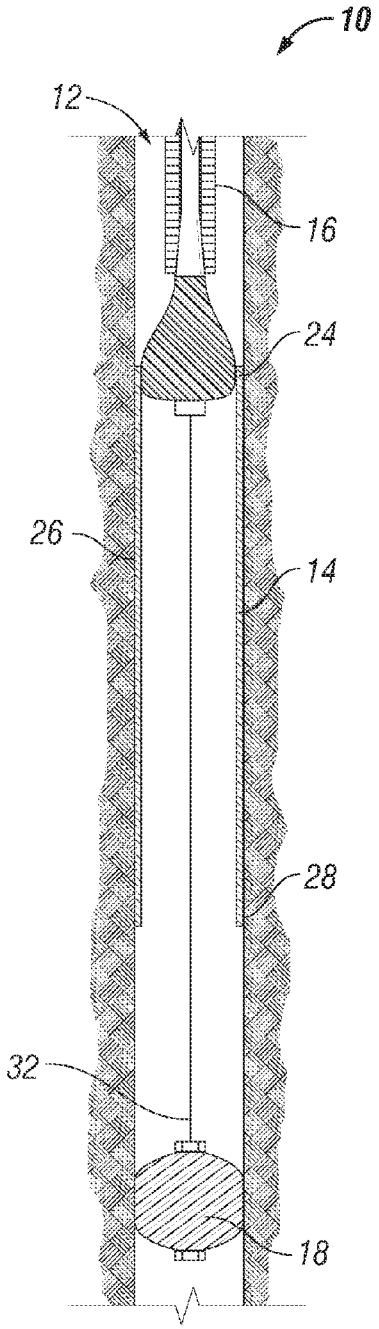
FIG. 5 is a cross-sectional view of the casing apparatus of FIG. 1, showing the conclusion of the deformation process by the moving device.

The tubular sleeve 14 shown in the drawings is expandable and undergoes an expansion process during operation as shown in FIGS. 4 and 5. It should be noted that the tubular sleeve 14 can be made of a non-expandable material and undergoes an unfolding process only without expanding. Alternatively, the tubular sleeve 14 can be made to undergo both unfolding and expansion process during operation. As previously set forth, the terms "deform", "deformable" or "deformation" used throughout the present disclosure cover all three situations.

In case the tubular sleeve 14 is made of an expandable material, the tubular sleeve 14 can be expanded with or without heating depending on the construction of the tubular sleeve 14. When the tubular sleeve 14 is made of a rigid composite tube, heating is generally required for expanding the tubular sleeve 14. However, when the tubular sleeve 14 is in the form of fibers and woven with structural fibers, heating is generally not necessary and such tubular sleeve 14 is easier to roll on a drum.

When the tubular sleeve 14 is of a composite structure, the tubular sleeve 14 may have one of the following constructions, for example:

1. A sleeve of carbon/thermoplastic braids wherein the braids are soft/expandable and each wire of these braids is made with carbon fibers and thermoplastic fibers. The thermoplastic can be melted after being expanded.

2. A multilayer sandwiched sleeve with carbon and thermoplastics braids wherein the thermoplastic fibers and carbon fibers are braided separately.

3. A sleeve of carbon braids wrapped by thermoplastic bands/wires wherein the sleeve includes a layer of carbon braids, which is surrounded by a thermoplastic band or wire.

4. A pre-made composite carbon/thermoplastic sleeve wherein the thermoplastic and carbon fibers form a solid composite cylinder, which can have a circular cross-section. The fibers are set at a correct angle to allow deformation when the thermoplastic is melted. Fibers can also be set perpendicular to the cylinder axis. The cylinder can be folded on several generating lines. When the thermoplastic is soft enough, the deformation is performed by unfolding the sleeve.

5. A bi-axial composite sleeve wherein the sleeve is made with expandable fibers in one axis.

The preferred thermoplastic materials used in the composition of the tubular sleeve 14 include nylon materials such as polyamide 6 (PA6), polyamide 6,6 (PA6,6), or polyamide 12 (PA12), or even polyethersulfone (PES), polyphenylene sulfide (PPS), polyvinylidene fluoride (PVDF), polyetherimide (PEI) or PEEK thermoplastics. The carbon fibers are structural fibers to provide a structural support for the thermoplastic matrix. The fibers can be set with a low angle relative to the sleeve axis. As the tubular sleeve 14 is deformed, the angle is increased. Alternatively, the fibers can be rolled perpendicular to the sleeve axis so that the sleeve is folded before application and is unfolded, rather than expanded, during application.

Referring to FIGS. 1 through 7, the method of using the casing apparatus 10 for casing or repair a well is now described. FIG. 1 shows a running-in step, where the casing apparatus 10 including the setting tool 12 and the tubular sleeve 14 is lowered down into the well 26 to a desired depth adjacent to a section or zone of the well 28 to be cased or repaired.

Next, in an anchorage step as shown in FIG. 2, the anchoring device 18 is inflated by injecting fluid or air through the running tool 34, the connecting member 32. The anchoring device 18 is inflated to engage the well 26 so as to hold the lower end 28 of the tubular sleeve 14 in place. The anchoring device 18 may also be a mechanical expandable anchor.

In the anchorage step, the tensioning device 16, which holds the upper end 24 of the tubular sleeve 14, is operated to adjust the tension of the tubular sleeve 14 and maintain a proper tension in the longitudinal direction of the tubular sleeve 14. The tensioning device 16 and the anchoring device 18 keep the tubular sleeve 14 in place without being moved in the longitudinal direction by the moving device 20 during and/or following the deformation process. The tensioning device 16 may maintain a constant or variable tension of the tubular sleeve 14 during the deformation process, depending on the applications.

The tensioning device 16 may in some embodiments, be made of buoyant elements. The density of those elements and/or the volume of those elements can be selected to adjust the tension of the tubular sleeve 14 depending on the well fluid and the weight of the parts of the casing apparatus.

Next, as shown in FIG. 3, the moving device 20 is inflated to an inflated condition. The inflated condition of the moving device 20 is properly set to adapt for the thickness of the tubular sleeve 14 and the diameter of the well 26 to ensure that a proper pressure is applied to the tubular sleeve 14.

In this moving device inflation step, the heating device 22 is switched on for heating the tubular sleeve 14 to a melting point. Since the heating device 22 is disposed above the moving device 20, any part of the tubular sleeve 14 is heated before being deformed by the moving device 20.

In some cases, for some thermoplastic materials, heating may take place after the deformation process. Therefore, the heating device 22 may be disposed below the moving device 20 and heating is applied to the tubular sleeve 14 after that tubular sleeve 14 is deformed.

Referring to FIG. 4 which shows the start of the deformation process of the tubular sleeve 14, when the lower end 28 of the tubular sleeve 14 is heated and is ready for deformation, the cable 36 pulls upward the heating device 22 and the properly inflated moving device 20. As the moving device 20 is moved past the part of the tubular sleeve 14 that has been heated, the moving device 20 deforms the heated part of the tubular sleeve 14 radially against the well 26.

Preferably, the heating device 22 and the moving device 20 are moved at a lower speed that ensures that the part of the tubular sleeve 14 to be deformed by the moving device 20 is sufficiently heated and deformed. As the moving device 20 is moved from the lower end 28 to the upper end 24, the tubular sleeve 14 is progressively deformed from the lower end 28 to the upper end 24 until the entire sleeve 14 is deformed. At the same time, the tubular sleeve 14 is progressively cooled down and sets-up from the lower end 28 to the upper end 24. As with most thermoplastic materials, as they are cooled down, they naturally recover mechanical properties, and as such, they set-up.

In those embodiments where the sleeve 14 is passed through a tubing, a well patch (such as Patch Flex), or any other inner diameter casing restriction, the heating device 22 and the moving device 20 may be moved at a speed that ensures the tubular sleeve 14 expands at the same expansion rate as casing restriction. This feature allows setting of the sleeve after passing through tubing or after passing through any inner diameter casing restriction.

While in this illustrative example, the heating device 22 is moved together with the moving device 20 to apply heat and pressure to the tubular sleeve 14 in substantially the same time, it is within the contemplation of the present disclosure that the heating device 22 can be moved independently of the moving device 20 and heat the entire tubular sleeve 14 before the deformation process begins. It is also within the contemplation of the present disclosure that the heating device 22 may be made stationary.

As previously described, the moving device 20 can be partially or fully inflated to adapt for the thickness of the sleeve 14 and the diameter of the well 26. Additionally, the inflated conditions of the moving device 20 can be adjusted during the deformation process to apply a variable pressure on the tubular sleeve 14. One of the advantages is that only one tubular sleeve 14 is needed to case or repair a zone which does not have a constant diameter. The moving device 20 can be partially inflated in a section having a smaller diameter and can be fully inflated in a section having a larger diameter.

Figure 6:
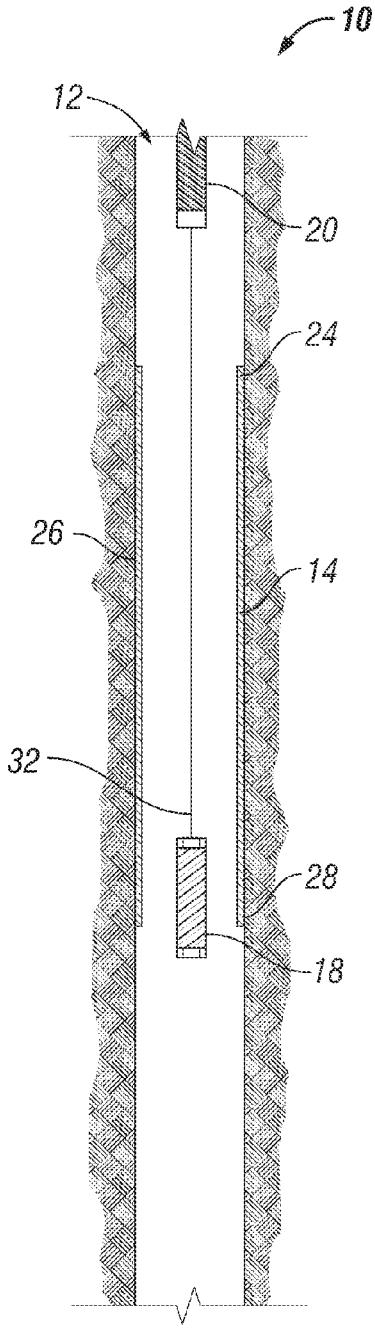
FIG. 6 is a cross-sectional view of the casing apparatus of FIG. 1, showing the moving device and the anchoring device in their deflated condition ready for withdrawal.
Figure 7:
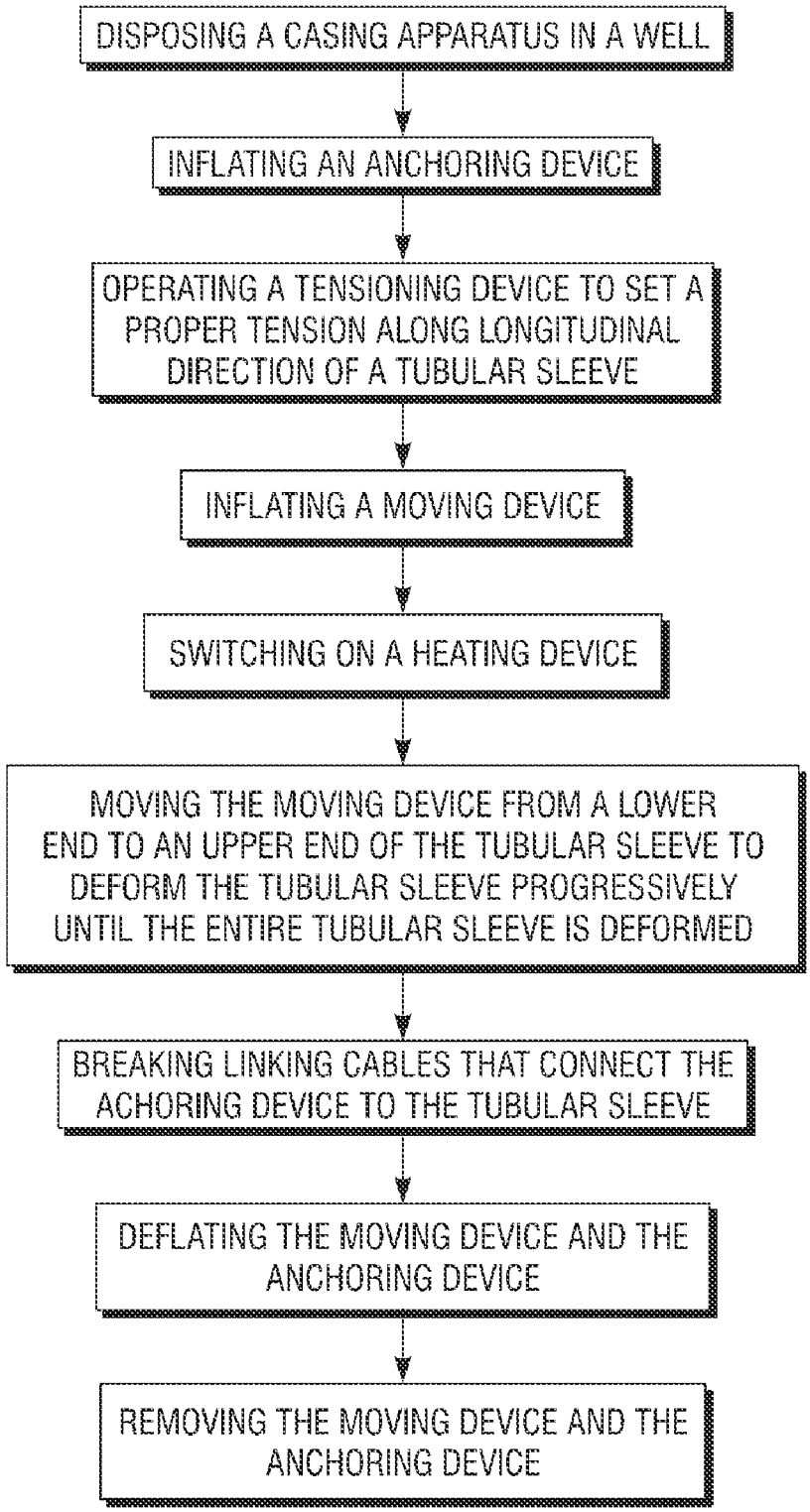
FIG. 7 is a schematic flow diagram of a method of casing or repairing the well.

Referring to FIG. 5, upon completion of the deformation process, the linking cable 30 is broken to separate the anchoring device 18 from the tubular sleeve 14. The linking cables 30 may breakable by connection to a mechanical weak point. Finally, as shown in FIG. 6, the anchoring device 18 and the moving device 20 are deflated and removed from the well 26, thereby completing the casing or repairing process.

It should be noted that while the tubular sleeve 14 has been described as being made of a thermoplastic material in the present disclosure, the tubular sleeve 14 can be made of a thermosetting material. Therefore, hardening the tubular sleeve 14 during the deformation process can be achieved by applying a cross-liking agent, radiation or ultraviolet, etc, other than heating or cooling. Therefore, a nozzle for spraying the cross-linking agent, a radiation source or an ultraviolet source may be incorporated in the setting tool 12 to facilitate polymerization of the tubular sleeve 14.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A casing apparatus for casing a wall of a well, comprising:

a deformable tubular sleeve having a first end and a second end;

a moving device movable inside the deformable tubular sleeve along a longitudinal axis of the deformable tubular sleeve for deforming the tubular sleeve radially against the wall of the borehole; and an anchoring device being positioned on a downhole side of the deformable tubular sleeve and temporarily coupled to the deformable tubular sleeve by a linking member to anchor the deformable tubular sleeve, the anchoring device being removable through the deformable tubular sleeve after separating the linking member.

2. The casing apparatus according to claim 1, wherein the moving device is radially inflatable to an inflated condition and when the moving device is in the inflated condition and is moved from the first end to the second end, the moving device deforms the deformable tubular sleeve radially against the wall and progressively from the first end to the second end.

3. The casing apparatus according to claim 2, wherein when the moving device deforms the deformable tubular sleeve against the wall, the moving device applies a pressure to the tubular sleeve and wherein the pressure can be varied by changing the inflated condition of the moving device.

4. The casing apparatus according to claim 3, wherein the deformable tubular sleeve is deformed by a variable pressure along the length of the tubular sleeve.

5. The casing apparatus according to claim 1, wherein the moving device is radially deflatable to a deflated condition and when the moving device is in the deflated condition, the moving device is removable from the deformable tubular sleeve.

6. The casing apparatus according to claim 1, further comprising a cable connected to the moving device for moving the moving device from the first end to the second end.

7. The casing apparatus according to claim 1, further comprising a heating device disposed within the deformable tubular sleeve for heating the deformable tubular sleeve.

8. The casing apparatus according to claim 1, wherein the anchoring device is disposed adjacent to the first end of the deformable tubular sleeve for anchoring the deformable tubular sleeve to the wall of the borehole below the deformable tubular sleeve.

9. The casing apparatus according to claim 1, further comprising a tensioning device for maintaining a predetermined tension along the length of the tubular sleeve.

10. The casing apparatus according to claim 1, wherein the deformable tubular sleeve includes a thermoplastic material selected from a group consisting of PA6, PA66, PA 12, PES, PPS, PVDF, PEI and PEEK thermoplastics.

11. The casing apparatus according to claim 10, wherein the thermoplastic material is in the form of braided fibers.

12. A tool for deforming a deformable tubular sleeve, comprising:

a radially inflatable moving device movable inside the deformable tubular sleeve along a longitudinal axis, when the moving device is inflated to an inflated condition and moved from a first end toward a second end of the tubular sleeve, the moving device deforming the tubular sleeve radially and progressively from the first end toward the second end; and an anchoring device to anchor the deformable tubular sleeve, the anchoring device being selectively expandable and contractible, wherein the anchoring device and the radially inflatable moving device are simultaneously removable in a single trip upon deforming the tubular sleeve.

13. The tool according to claim 12, wherein when the moving device deforms the tubular sleeve, the moving device applies a pressure to the tubular sleeve and the pressure can be varied by changing the inflated condition of the moving device.

14. The tool according to claim 12, further comprising a heating device for heating the deformable tubular sleeve.

15. A method of casing a wall of a well, comprising:

disposing a casing apparatus in the borehole, the casing apparatus comprising a deformable tubular sleeve and a moving device, the moving device being radially inflatable and being movable inside the tubular sleeve from a first end toward a second end of the deformable tubular sleeve;

temporarily anchoring the tubular sleeve with an anchoring device located downhole from the deformable tubular sleeve and connected to the deformable tubular sleeve with a linking member;

inflating the moving device to an inflated condition; and causing the moving device to move in the inflated condition from the first end toward the second end, a force being exerted on the tubular sleeve by the moving device in the inflated condition, when the moving device is moved from the first end to the second end, the tubular sleeve being deformed radially against the wall and progressively from the first end the second end; and releasing both the moving device and the anchoring device upon deformation of the deformable tubular sleeve.

16. The method according to claim 15, further comprising adjusting the force by changing the inflated condition of the moving device.

17. The method according to claim 15, further comprising heating the deformable tubular sleeve to a melting point of the deformable tubular sleeve.

18. The method according to claim 15, wherein temporarily anchoring comprises anchoring the deformable tubular sleeve to the wall of the borehole.

19. The method according to claim 15, further comprising maintaining a predetermined tension in a longitudinal direction of the deformable tubular sleeve.

20. The method according to claim 15, further comprising deflating and removing the moving device from the deformable tubular sleeve.

* * * * *